US008062193B2

(12) United States Patent
Oesterling

(10) Patent No.: US 8,062,193 B2
(45) Date of Patent: Nov. 22, 2011

(54) EXERCISE APPARATUS

(76) Inventor: Charlene Oesterling, Knoxville, TN (US)

( * ) Notice: Subject to any disclaimer, the term of this patent is extended or adjusted under 35 U.S.C. 154(b) by 0 days.

(21) Appl. No.: 12/816,577

(22) Filed: Jun. 16, 2010

(65) Prior Publication Data

US 2011/0077133 A1 Mar. 31, 2011

Related U.S. Application Data

(60) Provisional application No. 61/246,786, filed on Sep. 29, 2009.

(51) Int. Cl.
*A63B 5/20* (2006.01)

(52) U.S. Cl. ..... 482/82; 403/329

(58) Field of Classification Search ..... 482/44, 482/45, 81, 82, 92, 120, 126, 139, 148, 908; D21/672, 684; D8/107, 303, 305; 473/256, 473/424; 446/247; 285/33; 403/329, 397, 403/DIG. 4, DIG. 11, DIG. 14; 280/801.1, 280/801.2

See application file for complete search history.

(56) References Cited

U.S. PATENT DOCUMENTS

| | | | | |
|---|---|---|---|---|
| 4,637,606 | A * | 1/1987 | Hunn | 482/82 |
| 4,778,173 | A * | 10/1988 | Joutras | 482/82 |
| 4,801,137 | A * | 1/1989 | Douglass | 482/82 |
| 5,215,332 | A * | 6/1993 | De Sloovere | 280/801.1 |
| 5,697,871 | A * | 12/1997 | Landfair | 482/82 |
| 6,752,746 | B1 * | 6/2004 | Winkler et al. | 482/82 |
| 7,628,735 | B1 * | 12/2009 | Hsu | 482/82 |
| 2006/0128534 | A1 * | 6/2006 | Roque | 482/82 |

FOREIGN PATENT DOCUMENTS

GB 2092013 A * 8/1982

OTHER PUBLICATIONS

Duvide Jumpropes, Functional Jump Ropes & Equipment, Aug. 2010—http://duvide.com/staticpages/index.php/duvide-dg_en.

* cited by examiner

*Primary Examiner* — Loan Thanh
*Assistant Examiner* — Tam Nguyen
(74) *Attorney, Agent, or Firm* — Luedeka, Neely & Graham P.C.

(57) ABSTRACT

An exercise apparatus for jumping exercises including at last one handle and an appendage, the apparatus further including a first attachment member including an aperture defining a first zone and a second zone, the second zone shaped similar to a cylinder. The handle includes a hub that fits at least in part within the first zone and can be rapidly engaged within the second zone so to attach the appendage to the handle while allowing rotational movement of the hub within the second zone.

19 Claims, 9 Drawing Sheets

EXERCISE APPARATUS

CROSS-REFERENCE(S) TO RELATED APPLICATION(S)

This application claims priority to U.S. provisional patent application No. 61/246,786 to Charlene Oesterling which was filed on Sep. 29, 2009, and entitled "Fitness Tool," the content of which is incorporated herein by reference in its entirety.

STATEMENT REGARDING NOTICE OF COPYRIGHT

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

FIELD

This disclosure relates to the field of exercise equipment. More particularly, this disclosure relates to an exercise apparatus for use when performing jumping exercises.

BACKGROUND

Jump ropes and related fitness gear have been used for hundreds of years, but the science of using ropes and other elongate flexible members for various exercise regimens is rapidly becoming much more complex than a mere rope.

For example, Duvide™ jump ropes introduced an important aspect of jumping technology in the early 1990's including the relative orientation of handles with respect to the associated rope or other flexible material. For example, the Duvide™ brand dG model has handles that are oriented substantially orthogonal to the associated rope. The dG model also include hollow handles in which lead shot may be added to increase the weight of the handles.

Although the Duvide™ brand ropes offer some helpful features for trainers and exercise enthusiasts to have some flexibility when using such ropes, it is particularly cumbersome to alternate or otherwise replace one type of handle for another (or, as another example, one rope portion for another). Moreover, after mass in the form of lead shot is added through a considerably small hole in the end of a handle, such shot is very difficult to remove because each small piece must find its way through the small hole. Additionally, if a trainer wanted to be sure how much mass to add to a second handle, such trainer would have to literally weigh the first handle with loaded shot and then add shot to a second handle, weighing the second handle perhaps multiple times until the same weight measurement is reached.

What is needed, therefore, is an exercise apparatus for jump training that includes more convenient features.

SUMMARY

The above and other needs are met by an exercise apparatus for jumping exercises, such apparatus including modular parts that can be quickly assembled, disassembled, and reassembled with different/alternate component parts. For example, a first set of handles weighing 0.5 kg may be desirable during a first portion of a workout and then a second set of handles weighing 1.5 kg may be desirable for a second portion of a workout. As another example, a first type of rope or other flexible line may be desirable for use during a first portion of a workout based on, for example, the material the line is made of, the weight of the line, or the thickness of the line. The various embodiments described herein offer specific advantages related to these and other considerations as demonstrated in more detail herein.

In one embodiment, the exercise apparatus includes a first handle having a first end and a second end, wherein the first end of the first handle includes a substantially cylindrical shaped hub. The exercise apparatus further includes an appendage, the appendage includes a first flexible line and a first attachment member attached adjacent a first end of the first flexible line. The first attachment member includes a rigid frame defining a nonsymmetrical aperture therein, the aperture including a first zone and a second zone. The first zone has a width wider than the diameter of the first end of the first handle. The second zone includes a substantially cylindrical shape having a diameter substantially equal to the diameter of the second zone. The hub of the first handle is removably attached to the first attachment member at least partially within the second zone wherein the hub is free to rotate within the second zone.

In a first version, the exercise apparatus further includes a second handle having a first end and a second end wherein the first end of the second handle includes a substantially cylindrical shaped hub. The appendage further includes a second attachment member attached adjacent a second end of the first flexible line. The second attachment member includes a rigid frame defining a nonsymmetrical aperture therein. The aperture includes a first zone and a second zone. The first zone has a width wider than the diameter of the first end of the second handle, and the second zone is defined as including a substantially cylindrical shape having a diameter length substantially equal to the diameter of the substantially cylindrical shaped hub of the second handle. The first end of the second handle is removably attached to the second attachment member at least partially within the second zone. The hub of the second handle is free to rotate within the second zone of the second attachment member.

In a second version, the first handle further includes an elongate slug and an elongate shell defining a cavity therein for removably receiving the slug through a first end of the shell.

In a third version, the first handle further includes a bar connected to the substantially cylindrically shaped hub of the first handle.

In a fourth version, the first handle further includes a bar and a fastener having an elongate shank and a head disposed adjacent a first end of the shank. The second zone includes an aperture through which the elongate shank extends, and wherein a second end of the elongate shank is attached adjacent a first end of the bar.

In a fifth version, the first handle further includes a grip removably attached adjacent an outer surface of the elongate shell.

Referring to the first version, the exercise apparatus can include a first appendage that further includes a first fastener including a shank and a head disposed adjacent a first end of the shank. The first attachment member further includes a base aperture through which the shank of the first fastener extends and is attached adjacent the first end of the first flexible line, whereby the first fastener is free to rotate within the base aperture of the first attachment member.

The exercise apparatus can also include a second appendage further including a second fastener including a shank and a head disposed adjacent a first end of the shank. The second attachment member further includes a base aperture through which the shank of the second fastener extends and is attached adjacent the second end of the first flexible line. The first fastener is free to rotate within the base aperture of the second attachment member.

Referring to the second version, the first handle can further include a spring positioned adjacent a second end of the shell within the cavity defined therein.

Alternatively or additionally, the elongate shell can further include the substantially cylindrical shaped hub, wherein the substantially cylindrical shaped hub defines a second end of the elongate shell.

Alternatively or additionally, the first handle can further include a fastener including an elongate shank and a head disposed adjacent a first end of the shank, wherein the second zone includes an aperture through which the elongate shank extends, and wherein a second end of the elongate shank is attached adjacent a second end of the elongate shell;

Alternatively or additionally, the first handle can further include a grip removably attached adjacent an outer surface of the elongate shell.

Regarding the previous embodiment, the slug may further include a raised edge. Additionally, the grip is located adjacent the elongate shell between the raised edge of the slug and the first attachment member.

Referring again to the second version, in still another embodiment, the elongate slug can further include a first protrusion extending from a lateral surface of the slug, wherein the elongate shell further includes an open groove extending from a first edge of the shell to form a cul-de-sac, and wherein the slug is removably engaged with the shell by maneuvering the protrusion along the open groove to a location proximate the terminus of the cul-de-sac.

Regarding the previous embodiment, the exercise apparatus may further include a pin. In this embodiment, the slug further includes an aperture through which the pin is removably situated in a manner in which a first end of the pin protrudes from a first side of the slug forming the first protrusion and a second end of the pin protrudes from a second side of the slug forming a second protrusion. The elongate shell further includes a second open groove extending from the first edge of the shell to form a second cul-de-sac. The slug is removably engaged with the shell by maneuvering the second protrusion along the second open groove to a location proximate the terminus of the second cul-de-sac.

Referring again to the second version, in yet another embodiment, the elongate slug may further include a first protrusion extending from a lateral surface of the slug. In this embodiment, the elongate shell further includes an aperture located a first distance from the first edge of the shell. The slug is removably engaged with the shell by maneuvering the protrusion so that the protrusion becomes located at least in part within at least some of the area defined by the aperture.

Referring to the fifth version, the grip can further include a substantially hollow elongate body for fitting over at least a portion of the elongate shell and a strap. The first end of the strap is attached adjacent a first end of the elongate body. The second end of the strap is attached adjacent a second end of the elongate body.

Alternatively, in another embodiment, a kit includes the exercise apparatus wherein the elongate slug has a first mass, and a second slug has a second mass. The first mass and the second mass are unequal.

Regarding the previous embodiment, the exercise apparatus can include a second appendage including a second flexible line. The second flexible line is characteristically distinguishable from the first flexible line.

BRIEF DESCRIPTION OF THE DRAWINGS

Further features, aspects, and advantages of the present disclosure will become better understood by reference to the following detailed description, appended claims, and accompanying figures, wherein elements are not to scale so as to more clearly show the details, wherein like reference numbers indicate like elements throughout the several views, and wherein:

DETAILED DESCRIPTION

Various terms used herein are intended to have particular meanings. Some of these terms are defined below for the purpose of clarity. The definitions given below are meant to cover all forms of the words being defined (e.g., singular, plural, present tense, past tense). If the definition of any term below diverges from the commonly understood and/or dictionary definition of such term, the definitions below control. Flexible Line: any elongate material with sufficient flexibility for use in a manner similar to a common jump rope, such material including, without limitation, tubing, cable, twine, rope, band, and/or combinations thereof, such line forms made from materials including, without limitation, plastic, rubber, composite materials, plant matter (e.g., wood), metal and/or combinations thereof.

Figure 1:
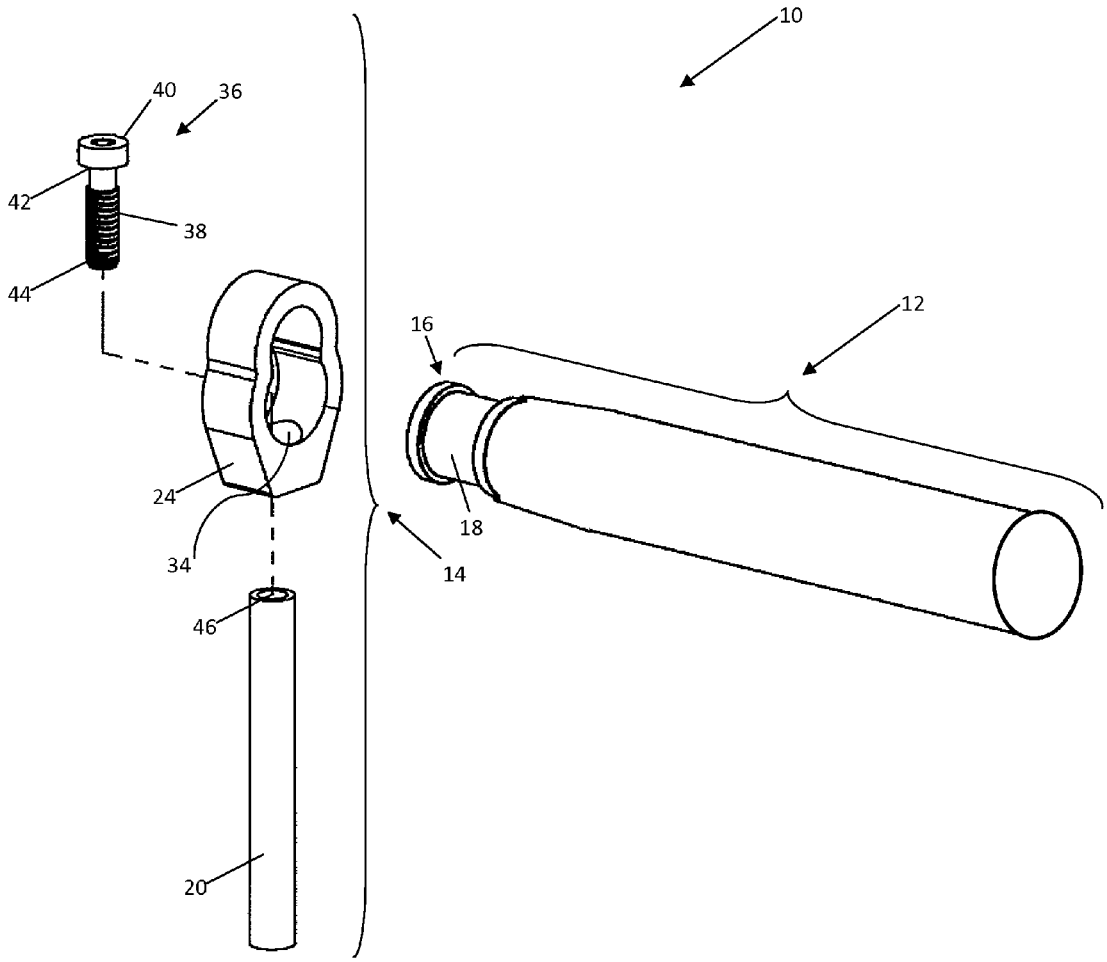
FIG. 1 shows an exploded view of an embodiment of an exercise apparatus including a handle and an appendage.
Figure 2A:
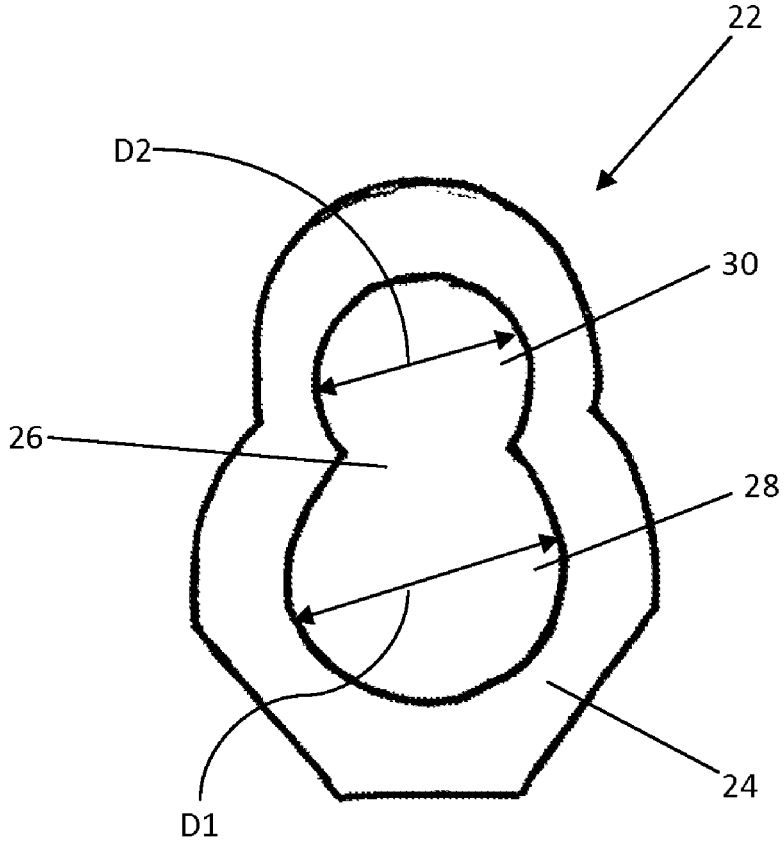
FIG. 2A shows an elevation view of an attachment member.
Figure 2B:
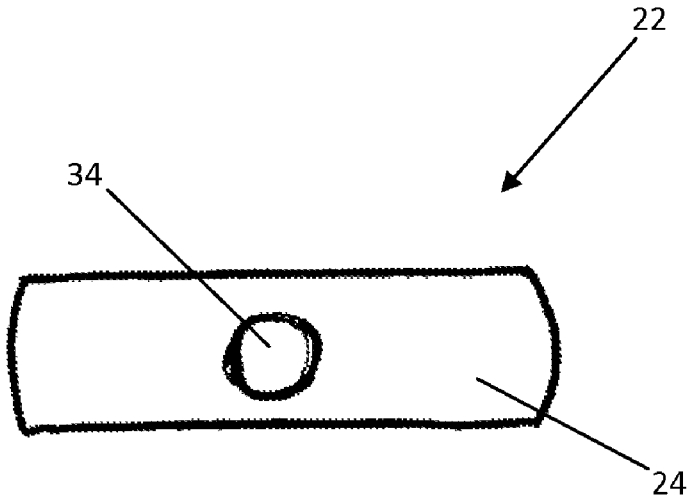
FIG. 2B shows an overhead view of an attachment member of FIG. 2A.
Figure 3:
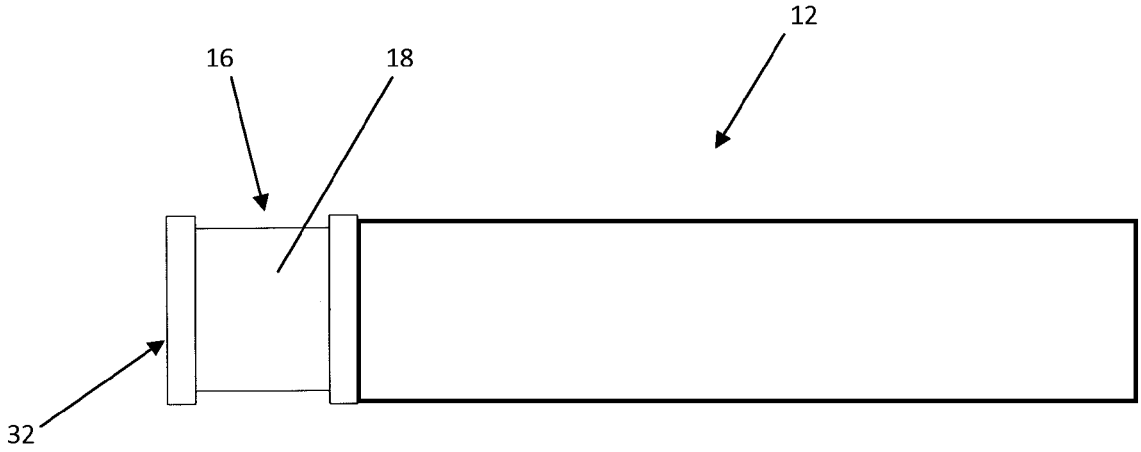
FIG. 3 shows a front view of the handle shown in FIG. 1.

FIGS. 1-3 show an embodiment of an exercise apparatus 10 as disclosed herein including a first handle 12 and an appendage 14. The first handle 12 includes a hub 16 including a substantially cylindrical shaped mid-section 18. The appendage 14 includes a first flexible line 20 and a first attachment member 22. The first attachment member 22 further includes a rigid frame 24 defining a nonsymmetrical aperture 26 within the frame 24. When viewed from the side, the aperture 26 appears similar to the outline of a figure "8" including a first zone 28 and a second zone 30. The second zone is preferably shaped like a cylinder. The width D1 of the first zone is greater than the width W1 of a first end 32 of the first handle 12. Because of the difference in length between D1 and W1, the first end 32 of the first handle 12 fits loosely within the first zone 28 with room for lateral movement for the first handle 12 of at least 1 millimeter within the first zone 28. The length of the first handle 12 preferably ranges from about 4.50 to about 5.50 inches, the length of the mid-section 18 preferably ranges from about 0.45 inches to about 0.55 inches.

Unlike the first zone 28, however, the second zone 30 has a diameter (or "average width" in some embodiments) D2 that is substantially equal to the width of the first end 32 (W1). Here, the term "substantially equal to" comparing W1 and D2 is meant to connote a snug relationship or "snap" fit whereby the hub 16 of the first handle 32 is free to rotate within the second zone 30 but is held secure in substantially all other directions unless and until a user forces the hub 16 from the second zone 30 to the first zone 28, for example, to disengage the first handle 12 from the appendage 14. In one embodiment, the length of W1 preferably ranges from about 0.65 inches to about 0.80 inches, and more preferably from about 0.70 inches to about 0.75 inches; the length D1 preferably ranges from about 0.80 inches to about 1.0 inches, and more preferably from about 0.85 inches to about 0.95 inches; and the length D2 preferably ranges from about 0.65 inches to about 0.85 inches, and more preferably from about 0.70 inches to about 0.80 inches.

Preferably, the first attachment member 22 includes a base aperture 34 located along the frame 24. In one specific embodiment, the appendage 14 further includes a first fastener 36 including an elongate shank 38 and a head 40 attached adjacent a first end 42 of the shank 38. The shank 38 extends through the base aperture 34 and the head 40 keeps the fastener 36 from passing all of the way through the base aperture 34. A second end 44 of the shank 38 is attached adjacent a first end 46 of the flexible line 20.

Figure 4:
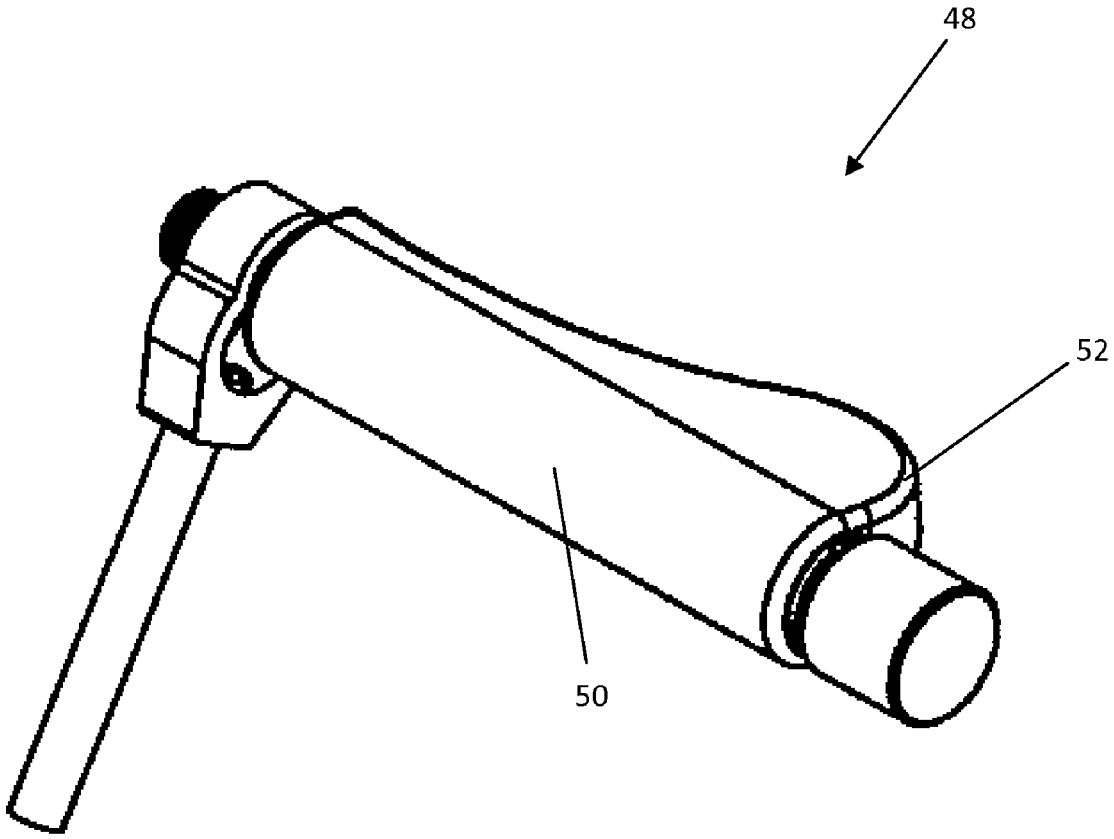
FIG. 4 shows a perspective view of the handle from FIG. 1 in a non-exploded view.

In a related embodiment, an exercise apparatus 48 shown in FIG. 4 similar to the exercise apparatus shown in FIGS. 1-3 further includes a grip 50. Preferably, the grip 50 further includes a strap 52 through which a user can place fingers during use of the exercise apparatus 48.

Figure 5:
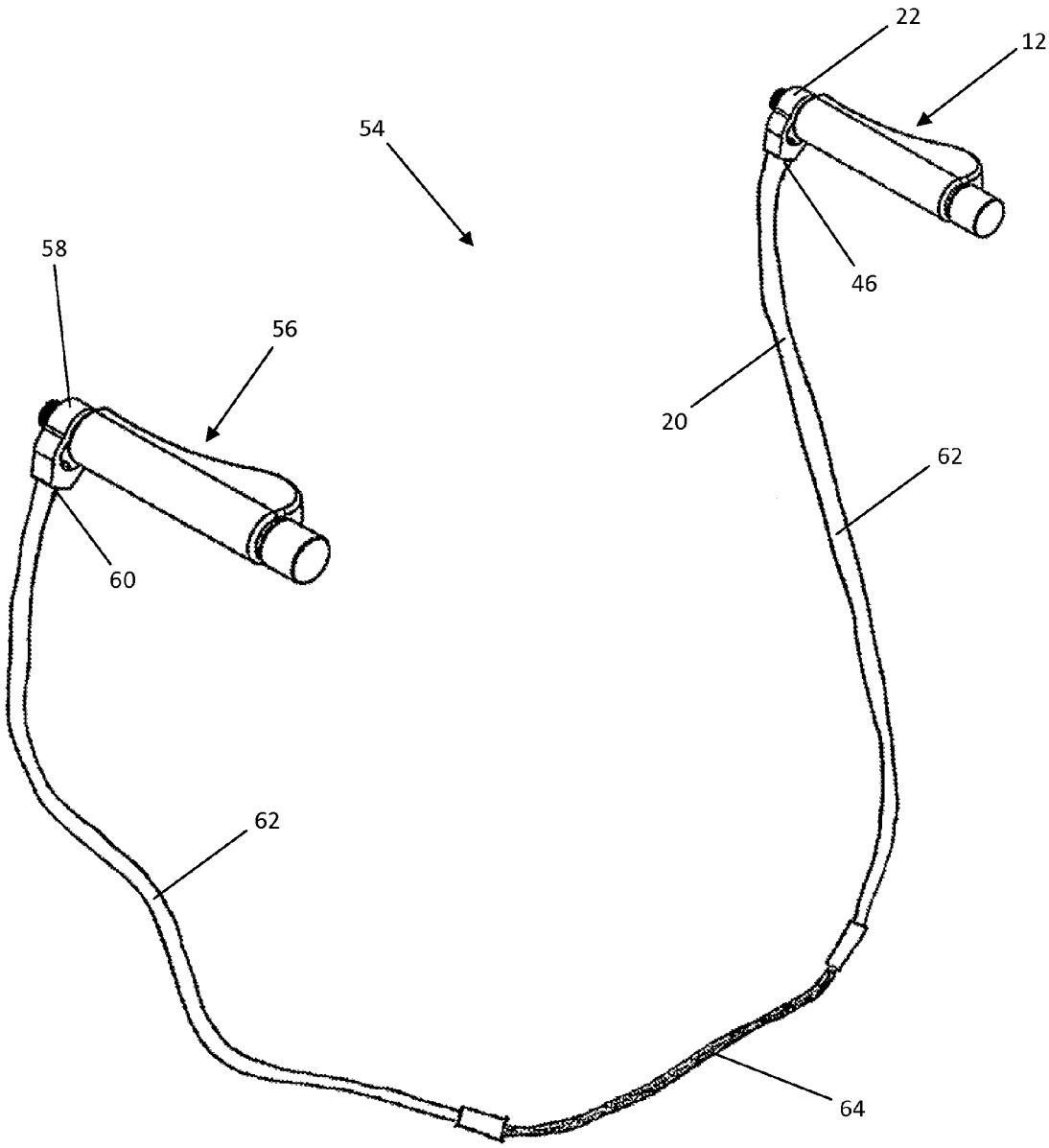
FIG. 5 shows an illustration of another embodiment of an exercise apparatus having a first and second handle attached to a first and second end of a flexible line.

FIG. 5 shows yet another embodiment of the disclosure including an exercise apparatus 54 which further includes a second handle 56 and a second attachment apparatus 58. The second attachment apparatus 58 is attached to a second end 60 of the flexible line 20. Preferably, the first handle 12 weighs substantially the same as the second handle 56. Additional equally weighted pairs of handles can be included, such pairs having different weights so that a user can easily and efficiently change out one pair of weighted handles for a second pair of weighted handles.

As shown in FIG. 5, the flexible line 20 can be further subdivided into additional sections including a non-wear section 62 and a wear section 64. The wear section 64 tends to come into contact with other surfaces more often than the non-wear section 62 during use. Therefore, the wear section 64 is replaced more often than the non-wear section 62. In an exemplary embodiment, the non-wear section 62 includes, for example, reinforced PVC hose having a diameter ranging from about 8 mm to about 12 mm; and the wear section 64 includes a solid polyurethane belt having a width ranging from about 6 mm to about 10 mm. The non-wear section 62 and the wear section 64 are preferably attached using, for example, a short overlapping layer of PVC hose 65 (shown in FIG. 5), tacks, ties (including, for example, metal wire, plastic bands, or other appropriate tying material).

Figure 6:
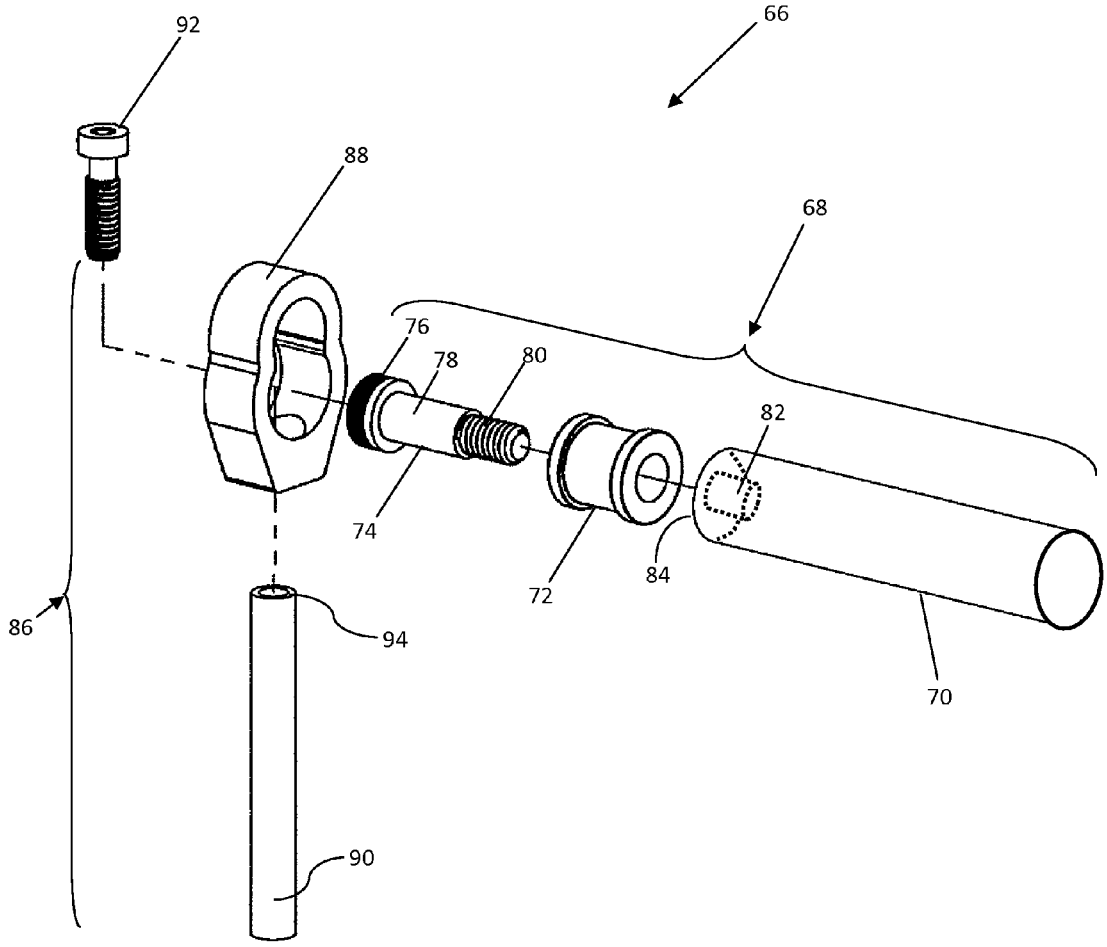
FIG. 6 shows an exploded view of another embodiment of an exercise apparatus including a first handle and an appendage.

FIG. 6 shows another embodiment of an exercise apparatus 66 including a first handle 68 which further includes a bar 70, a hub 72, and a fastener 74. The fastener 74 shown in FIG. 6 is in the form of a bolt including a head 76 and an elongate shank 78 wherein a first end 80 of the bolt is threaded so as to be received and attached in a bar cavity 82 along a first end 84 of the bar 70. The exercise apparatus 66 further includes an appendage 86 including a first attachment member 88, a flexible line 90, and a fastener 92 for attaching the first attachment member 88 adjacent a first end 94 of the flexible line 90 in similar fashion to the embodiment shown in FIG. 1. In one embodiment, the exercise apparatus 66 further includes a grip like, for example, the grip 50 shown in FIG. 4.

Figure 7:
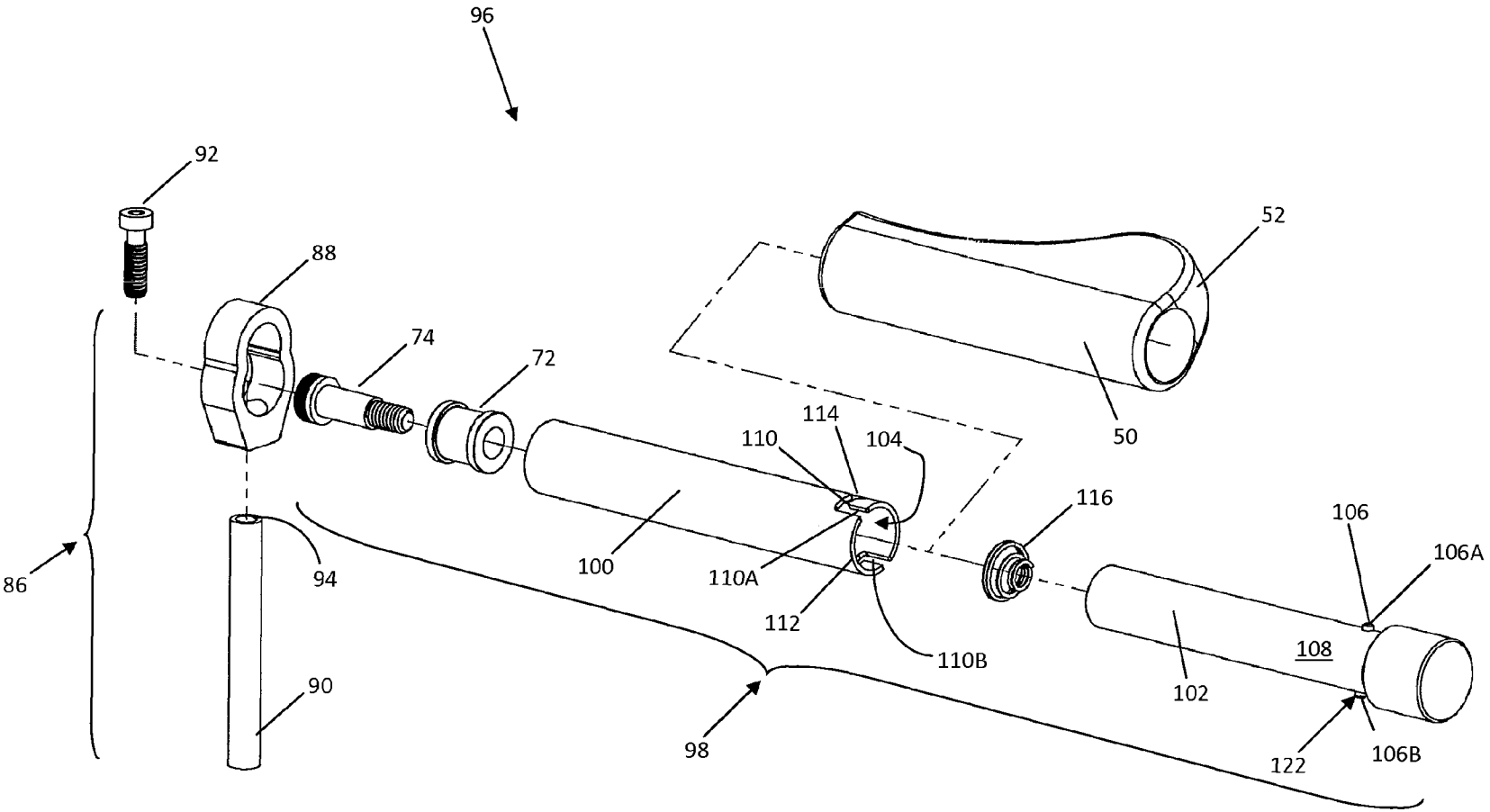
FIG. 7 shows an exploded view of another embodiment of an exercise apparatus.

A more advanced embodiment of an exercise apparatus 96 is shown in FIGS. 7-8 including a first handle 98 which further includes the hub 72, the fastener 74, an elongate shell 100, and an elongate slug 102. The shell 100 is preferably substantially cylindrical in shape including an internal cavity 104 for receiving the slug 102. At least some of the shape of the slug 102 preferably conforms closely with the shape of at least some of the cavity 104 so that all or part of the slug fits snug within some or all of the cavity 104. The slug 102 includes at least one protrusion 106 extending from a lateral surface 108 of the slug. In one embodiment, the shell 100 includes at least one open groove 110 starting from a proximal end 112 of the shell 100 and preferably defining a meandering pattern to a distal terminus 114. During attachment of the slug 102 to the shell 100, the protrusion 106 enters the open groove 110 at the proximal end 112 of the shell and follows the meandering pattern to the distal terminus 114, thereby removably locking the slug 102 in place with the shell 100. Preferably, a spring 116 is positioned proximate a distal end 118 of the cavity 104 to facilitate removal of the slug 102 and/or to help look the slug 102 in place with the shell 100 by creating pressure on the slug 102 oriented toward the proximal end 112 of the shell 100.

In the embodiment shown in FIG. 7, there are at least two protrusions 106A and 106B. The protrusions 106 are the ends of a pin 120 inserted into an aperture 122 through the slug 102. Because there are two protrusions 106A and 106B, there are also two open grooves 110A and 110B along the shell 100 corresponding to the protrusions 106A and 106B.

Figure 8A:
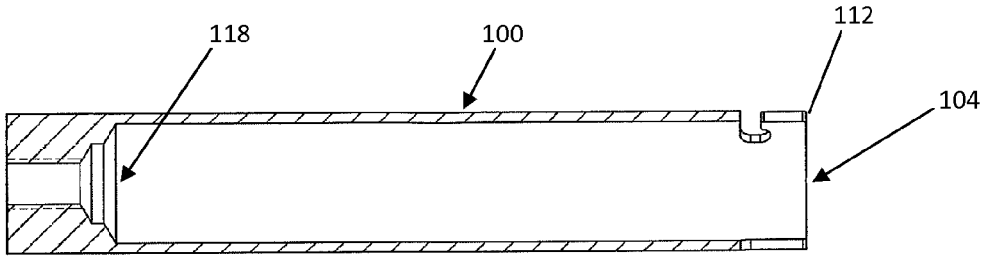
FIG. 8A shows a front section view of a shell.
Figure 8B:
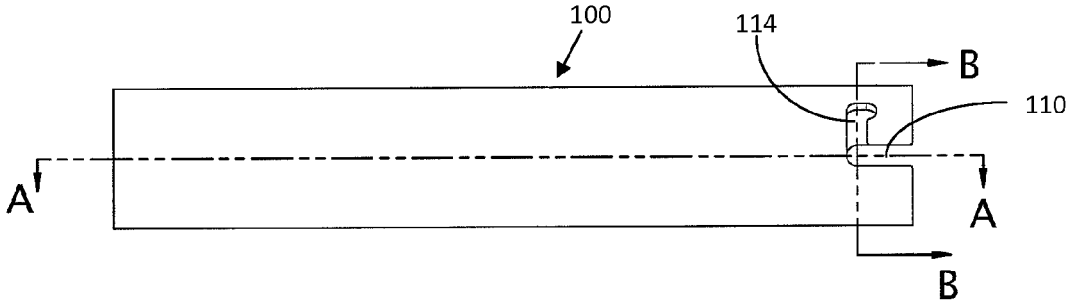
FIG. 8B shows a front view of the shell shown in FIG. 8B.
Figure 8C:
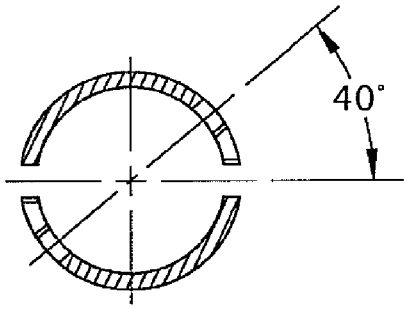
FIG. 8C shows side section view of the shell shown in FIGS. 8A and 8B.

FIG. 8A shows a cross-sectional view of the shell 100 as cut across line A-A in FIG. 8B. There, a first sub-cavity 126 for receiving the first end 80 of the fastener 74 as well as a second, larger sub-cavity 128 for housing the spring 116 can clearly be seen. FIG. 8C offers a cross-sectional view of the shell along line C-C, shown in FIG. 8B.

Figure 9:
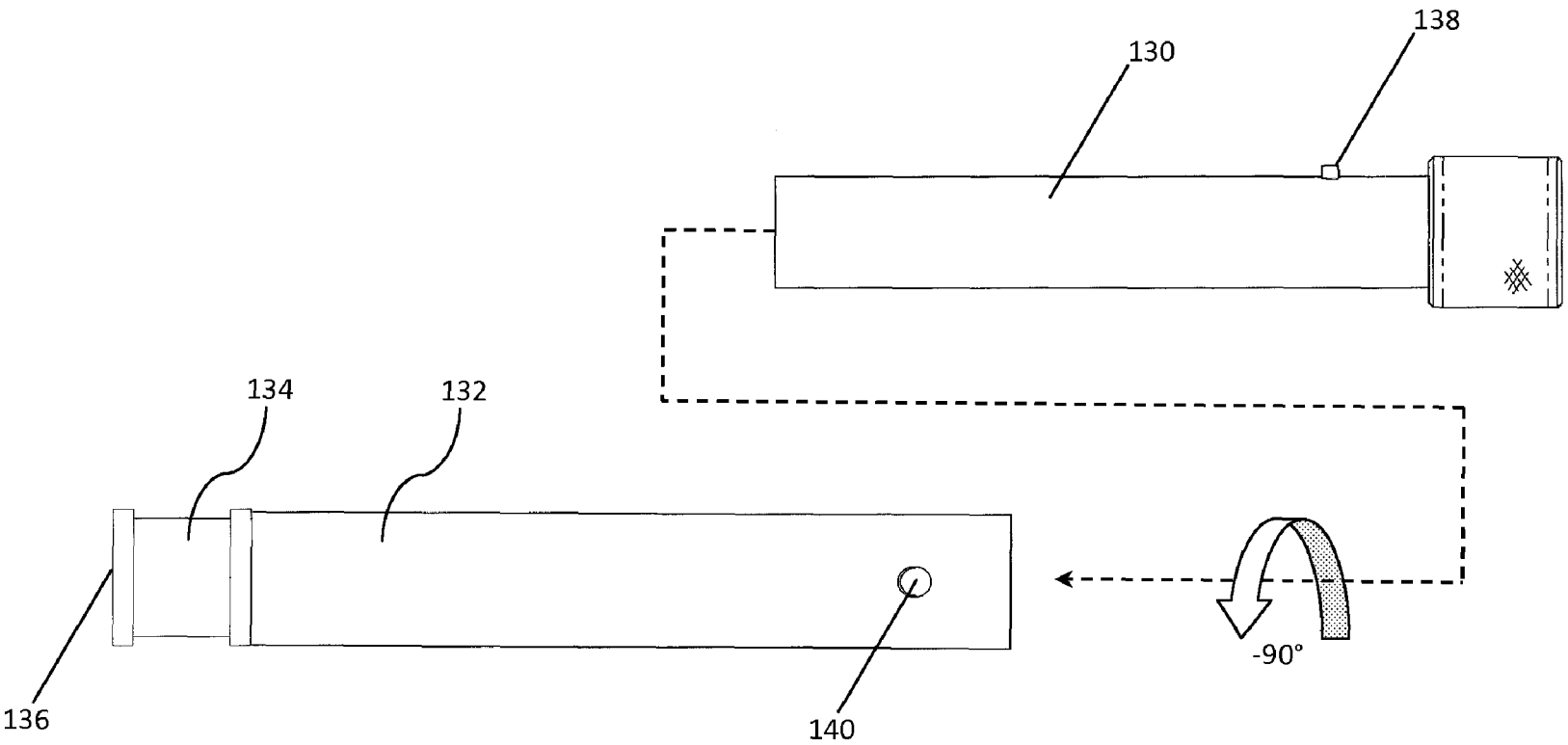
FIG. 9 shows a partially exploded view of another embodiment of a handle.

FIG. 9 shows another embodiment of certain portions of a handle including a slug 130 and a shell 132 wherein the shell 132 includes a hub 134 which defines a first end 136 of the shell 132. In this particular embodiment, the slug 130 further includes a protrusion 138 in the form of a pop-pin (e.g., a spring-loaded pop-pin). The protrusion 138 shown in FIG. 9 is configured to correspond with an aperture 140 along the shell 132 and pop into the aperture 140 during engagement of the slug 130 with the shell 132. The slug 130 and shell 132 may be disengaged rapidly and easily by simply pressing down on the pop-pin 138 and pulling the two objects apart from one another. The length of the shell 132 preferably ranges from about 4.50 inches to about 5.50 inches; the outside width or diameter of the shell 132 preferably ranges from about 0.80 inches to about 0.95 inches; the length of the slug 130 preferably ranges from about 4.50 inches to about 5.50 inches; and the width or diameter of the slug 130 preferably ranges from about 0.65 inches to about 0.85 inches.

In the examples shown in FIGS. 7-9, the slug 102 and the slug 130 include a raised edge 142. The raised edge 142 can be included to hem in the grip 50 between the raised edge 142 and the attachment member 88. Thus, in this example, when a slug is engaged with a shell, a grip may be slid on the shell before the slug is engaged. In this way, grips may be changed out in the same manner that slugs may be changed out. Certain grips with specific textures may be more desirable during specific types of workouts than other workouts. The embodiments shown, for example, in FIGS. 7-9 allow for the flexibility, therefore, to easily and rapidly substitute one pair of grips having a first characteristic with a second pair of grips having a second characteristic. Moreover, because grip types are not inextricably linked to particular weighted slugs, users with different preferences are free to interchange these features as desired.

Although specific examples of attached various embodiments of slugs to various embodiments of shells have been illustrated and described here in detail, many other fastening devices may be used within the spirit and scope of this disclosure and the appended claims. Similarly, although specific examples of threaded bolts have been illustrated for use in certain embodiments herein, other fastening devices may be used within the spirit and scope of this disclosure and the appended claims. For example, with respect to the exemplary handle 12 shown in FIG. 1 and FIG. 3, the hub 16 can be formed as a part of the handle 12 during manufacturing or, alternatively, the hub 16 can be attached to the rest of the handle 12 by an adhesive (e.g., an epoxy of other strong adhesive). The manner in which these and other parts described in the disclosure are attached is not meant to be limiting except at least with respect to the manner in which the attachment members engage with the handles which should include the specific examples disclosed and equivalents thereof.

Various parts of the embodiments described herein can be made using different materials including wood, metal, plastic, rubber, composites, other polymeric materials, or otherwise and such selection is not meant to be limiting. For ease of production, however, certain parts including, for example, the attachment members are preferably made from polymeric material in, for example, a molding and/or extrusion process.

The various embodiments of the disclosure are preferably used for exercises involving jumping or other plyometric, strength building, and/or cardiovascular enhancing activities.

In addition to specific apparatuses as described so far, this disclosure also contemplates a kit including, for example, a first pair of handles, an appendage, and a second pair of handles wherein the weight of the second pair of handles is characteristically distinguishable from the first pair of handles. In a related embodiment, a kit includes a first pair of handles, a first appendage, and a second appendage wherein the second appendage is characteristically distinguishable from the first appendage. The term "characteristically distinguishable" is meant to connote differences in characteristics such as weight, length, material type, material thickness, color, material textures, other similar physical characteristics, and/or combinations thereof.

In one particular embodiment, a kit includes a pair of handles, each like the handle illustrated in FIG. 7 wherein the pair of handles further includes a first pair of slugs having a weight of about 0.5 kg, a second pair of slugs each having a weight of about 1 kg, and a third pair of slugs each having a weight of about 2 kg. The kit further includes a first appendage having a first flexible line made of material including hollow polymer tubing that remains substantially empty within the tubing, and a second appendage including a second flexible line made of material including hollow polymer tubing wherein at least one elongate weight has been inserted within the tubing. Because of the design of the various embodiments associated with examples shown, for example, in FIG. 2 and FIG. 7, the pairs of slugs can be easily and rapidly interchanged by disengaging, for example, the first pair of slugs from the shells and engaging the second pair of slugs with the shells.

Similarly, the appendages can be easily and rapidly interchanged by disengaging, for example, the attachment members associated with the first appendage from, for example, the first pair of handles and then engaging the attachment members associated with the second appendage with the first pair of handles. The first pair of handles are each removably attachable to, for example, the first attachment member by inserting the substantially cylindrical shaped hub 72 of a handle 98 into the first zone 28 of the aperture 26 defined within an attachment member 22 and forcing the substantially cylindrical shaped hub 72 of the handle 98 into the second zone 30 defined within the attachment member 22. The hub 72 should snap fit into the second zone 30 tight enough so as to retain the hub 72 within the second zone 30 but loose enough so that the hub 72 is free to rotate within the second zone 30.

The previously described embodiments of the present disclosure have many advantages, including the ability to rapidly exchange parts of the apparatus (e.g., differently weighted slugs) during an exercise. If a flexible line breaks, for example, a second flexible line can be quickly substituted for the broken flexible line by attached a second appendage to the handles the user is using. The number of pairs of interchangeable handles is virtually limitless. For example, pairs of handles increasing by increments of, for example, 0.5 kg each can be included in a kit covering a range of handles from 0.5 kg each to, for example, 10 kg each, thereby providing the user with a broad range of weight options for handles during a workout. The same flexibility is provided with respect to different flexible lines as they can come in many different weights, styles, thicknesses, and of varying materials with varying characteristics. For example, a flexible line that is suitable for a strictly cardio jumping workout may not be as suitable for a primarily strength building workout due to the behavior of the flexible line during use of the apparatus. Thus, options abound with regard to this disclosure, providing seasoned athletes and beginners alike with a myriad of workout possibilities using the same overall apparatus and/or kit.

The use of specifically titled headings used herein and in the associated provisional application are for reference purposes only and should not be taken into consideration in the interpretation or construction with regard to novel aspects of the invention as disclosed herein and therein.

The foregoing description of preferred embodiments of the present disclosure has been presented for purposes of illustration and description. The described preferred embodiments are not intended to be exhaustive or to limit the scope of the disclosure to the precise form(s) disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the concepts revealed in the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

What is claimed is:

1. An exercise apparatus comprising a first handle including a first end and a second end wherein the first end of the first handle includes a substantially cylindrical shaped hub, and an appendage, the appendage including a first flexible line and a first attachment member connected to a first end of the first flexible line; the first attachment member including a rigid frame defining a nonsymmetrical aperture therein, the aperture including a first zone and a second zone wherein the first zone and the second zone partially overlap, the first zone having a width wider than the diameter of the first end of the first handle, and the second zone being defined as including a substantially cylindrical shape having a diameter substantially equal to the diameter of the substantially cylindrical shaped hub of the first handle; wherein the hub of the first handle is removably attached to the first attachment member at least partially within the second zone wherein the hub is free to rotate within the second zone.

2. The exercise apparatus of claim 1 further comprising a second handle including a first end and a second end wherein the first end of the second handle includes a substantially cylindrical shaped hub, wherein the appendage further comprises a second attachment member connected to a second end of the first flexible line, the second attachment member including a rigid frame defining a nonsymmetrical aperture therein, the aperture including a first zone and a second zone wherein the first zone and the second zone partially overlap, the first zone having a width wider than the diameter of the first end of the second handle, and the second zone being defined as including a substantially cylindrical shape having a diameter length substantially equal to the diameter length of the substantially cylindrical shaped hub of the second handle, wherein the first end of the second handle is removably attached to the second attachment member at least partially within the second zone wherein the hub of the second handle is free to rotate within the second zone of the second attachment member.

3. The exercise apparatus of claim 2 wherein the first appendage further comprises a first fastener comprising a shank and a head disposed adjacent a first end of the shank, wherein the first attachment member further comprises a base aperture through which the shank of the first fastener extends and is attached adjacent the first end of the first flexible line, whereby the first fastener is free to rotate within the base aperture of the first connected to member.

4. The exercise apparatus of claim 3 wherein the second appendage further comprises a second fastener comprising a shank and a head disposed adjacent a first end of the shank, wherein the second attachment member further comprises a base aperture through which the shank of the second fastener extends and is connected to the second end of the first flexible line, whereby the second fastener is free to rotate within the base aperture of the second attachment member.

5. The exercise apparatus of claim 1 wherein the first handle further comprises an elongate slug and an elongate shell defining a cavity therein for removably receiving the slug through a first end of the shell.

6. The exercise apparatus of claim 1 wherein the first handle further comprises a bar connected to the substantially cylindrical shaped hub of the first handle.

7. The exercise apparatus of claim 1 wherein the first handle further comprises a bar and a fastener including an elongate shank and a head disposed adjacent a first end of the shank, wherein the substantially cylindrical shaped hub of the first handle includes an aperture through which the elongate shank extends, and wherein a second end of the elongate shank is connected to a first end of the bar.

8. The exercise apparatus of claim 5 wherein the first handle further comprises a spring positioned adjacent a second end of the shell within the cavity defined therein.

9. The exercise apparatus of claim 5 wherein the elongate shell further comprises the substantially cylindrical shaped hub of the first handle, the substantially cylindrical shaped hub defining a second end of the elongate shell.

10. The exercise apparatus of claim 5 wherein the first handle further comprises a fastener including an elongate shank and a head disposed adjacent a first end of the shank, wherein the substantially cylindrical shaped hub of the first handle includes an aperture through which the elongate shank extends, and wherein a second end of the elongate shank is attached adjacent a second end of the elongate shell.

11. The exercise apparatus of claim 1 wherein the first handle further comprises a grip removably attached adjacent an outer surface of the an elongate shell of the first handle.

12. The exercise apparatus of claim 5 wherein the first handle further comprises a grip removably attached adjacent an outer surface of the elongate shell.

13. The exercise apparatus of claim 11 wherein the grip further comprises a substantially hollow elongate body for fitting over at least a portion of the elongate shell and a strap wherein a first end of the strap is attached adjacent a first end of the elongate body and wherein a second end of the strap is attached adjacent a second end of the elongate body.

14. The exercise apparatus of claim 12 wherein the slug further comprises a raised edge and wherein the grip is located adjacent the elongate shell between the raised edge of the slug and the first attachment member.

15. The exercise apparatus of claim 5 wherein the elongate slug further comprises a first protrusion extending from a lateral surface of the slug, wherein the elongate shell further comprises an open groove extending from a first edge of the shell to form a cul-de-sac, and wherein the slug is removably engaged with the shell by maneuvering the protrusion along the open groove to a location proximate the terminus of the cul-de-sac.

16. The exercise apparatus of claim 15 further comprising a pin, wherein the slug further comprises an aperture through which the pin is removably situated in a manner in which a first end of the pin protrudes from a first side of the slug forming the first protrusion and a second end of the pin protrudes from a second side of the slug forming a second protrusion, wherein the elongate shell further comprises a second open groove extending from the first edge of the shell to form a second cul-de-sac, and wherein the slug is removably engaged with the shell by maneuvering the second protrusion along the second open groove to a location proximate the terminus of the second cul-de-sac.

17. The exercise apparatus of claim 5 wherein the elongate slug further comprises a first protrusion extending from a lateral surface of the slug, wherein the elongate shell further comprises an aperture located a first distance from the first edge of the shell, and wherein the slug is removably engaged with the shell by maneuvering the protrusion so that the protrusion becomes located at least in part within at least some of the area defined by the aperture.

18. A kit comprising the exercise apparatus of claim 5 wherein the elongate slug has a first mass, the kit further comprising a second slug having a second mass, wherein the first mass and the second mass are unequal.

19. The kit of claim 18 further comprising a second appendage including a second flexible line, wherein the second flexible line is characteristically distinguishable from the first flexible line.

* * * * *